US005647340A

United States Patent [19]

Shimek et al.

[11] Patent Number: 5,647,340

[45] Date of Patent: Jul. 15, 1997

[54] CONVERTIBLE DUAL DIRECT-VENTED FIREPLACE

[75] Inventors: Ronald John Shimek, Prior Lake; Daniel Curtis Shimek, Apple Valley, both of Minn.

[73] Assignee: Heat-n-Glow, Savage, Minn.

[21] Appl. No.: 588,867

[22] Filed: Jan. 19, 1996

[51] Int. Cl.[6] ..... F24C 3/00

[52] U.S. Cl. ..... 126/85 B; 126/512; 126/515; 126/521

[58] Field of Search ..... 126/512, 85 B, 126/515, 517, 518, 516

[56] References Cited

U.S. PATENT DOCUMENTS

| | | | |
|---|---|---|---|
| 3,906,925 | 9/1975 | Dyer | 126/85 B |
| 5,076,254 | 12/1991 | Shimek et al. | 126/515 |
| 5,114,336 | 5/1992 | Karabin et al. | 126/512 |
| 5,191,877 | 3/1993 | Shimek et al. | 126/512 |
| 5,398,669 | 3/1995 | McCullough et al. | 126/512 |

*Primary Examiner*—Carroll B. Dority
*Attorney, Agent, or Firm*—John B. Sowell-Att.

[57] ABSTRACT

A novel dual direct vented fireplace includes a combustion chamber having two permanent exhaust outlets including a horizontal exhaust outlet and a vertical exhaust outlet. A fireplace enclosure surrounds at least the top, bottom and back of said combustion chamber forming three hollow plenum walls around the combustion chamber. A fresh air duct in the top and back plenum walls connects to a combustion air passageway under the gas burner system. Two permanent air inlets in said fresh air duct include a horizontal air inlet and a vertical air inlet. A coaxial pipe is provided for connection to at least one of said exhaust outlets and one of said air inlets. The other of said exhaust outlets and air inlets is covered with a closure whereby the dual direct-vented fireplace is assembled at the factory or in the field as either a horizontal or a vertical direct vented fireplace.

13 Claims, 4 Drawing Sheets

CONVERTIBLE DUAL DIRECT-VENTED FIREPLACE

BACKGROUND OF THE INVENTION

1. Field of the Invention

The present invention relates to zero clearance fireplaces of the type installed abutting or adjacent to an exterior wall of a room to be heated. More particularly, the present invention relates to low cost, high volume, prefabricated universal fireplaces intended to be direct vented from either a horizontal or a vertical vent and exhaust stack.

2. Description of the Prior Art

Direct-vented gas fireplaces are known. Our U.S. Pat. No. 4,793,322 shows and describes a high efficiency direct-vented fireplace having a separate and distinct structure for a horizontal vented fireplace and a vertical-vented fireplace. This fireplace has met with commercial success but requires separate distinct manufacturing procedures and also requires separate inventory and accounting procedures for two distinct products.

Universal direct-vented fireplaces are also known. Our U.S. Pat. No. 5,452,708 shows and describes a direct-vented fireplace having a vent directed outward from a 45 degree angle which is adapted to be connected to a 45 degree elbow pipe to provide either a horizontal or a vertical direct-vented fireplace. This fireplace requires seven outside walls and a combustion chamber effectively having both a vertical back wall and a diagonal back wall. There is an associated cost of manufacturing this extra back wall. However, there is a reduced cost associated with reduced manufacturing and inventorying of a single fireplace which more than offsets the additional manufacturing costs.

It would be desirable to provide a universal horizontal-vertical fireplace which would offer the aforementioned reduced cost associated with the manufacturing or inventorying a single fireplace item. It would be further desirable to simplify the fireplace structure to further reduce cost and to increase the efficiency and heating output for the same size fireplace box and to adapt the combustion chamber to employ a variety of gas burners.

SUMMARY OF THE INVENTION

It is a principal object of the present invention to provide a universal dual direct-vented fireplace structure.

It is a principal object of the present invention to provide a universal fireplace having a horizontal direct exhaust stack and vent pipe as well as a vertical exhaust stack and vent pipe either of which is selectable in the field to provide a horizontal or vertical direct-vented fireplace.

It is a another principal object of the present invention to provide a single dual direct-vented fireplace which is easily converted in the field into one of two direct-vented fireplaces.

It is a another principal object of the present invention to provide a dual direct-vented fireplace with a removable convertible floor in the combustion chamber for accommodating a plurality of different burner systems and patterns.

Another principal of the present invention is to provide a dual direct-vented fireplace which converts to a single direct vented fireplace in the field without use of additional parts or tools.

According to these and other objects of the present invention there is provided a novel dual direct-vented fireplace which comprises a combustion chamber located inside of a fireplace enclosure made of metal panels and separated therefrom on at least the top, back and bottom sides to form a heat exchanger in the top, back and bottom walls. The combustion chamber is further provided with dual vents comprising a vertical top vent and a horizontal back vent. A sealing closure is further provided which covers and seals one of the dual vents, thus, converting the dual direct-vented fireplace to a single direct-vented fireplace in the field without the requirement of tools or additional parts.

DESCRIPTION OF THE PREFERRED EMBODIMENTS

Figure 1:
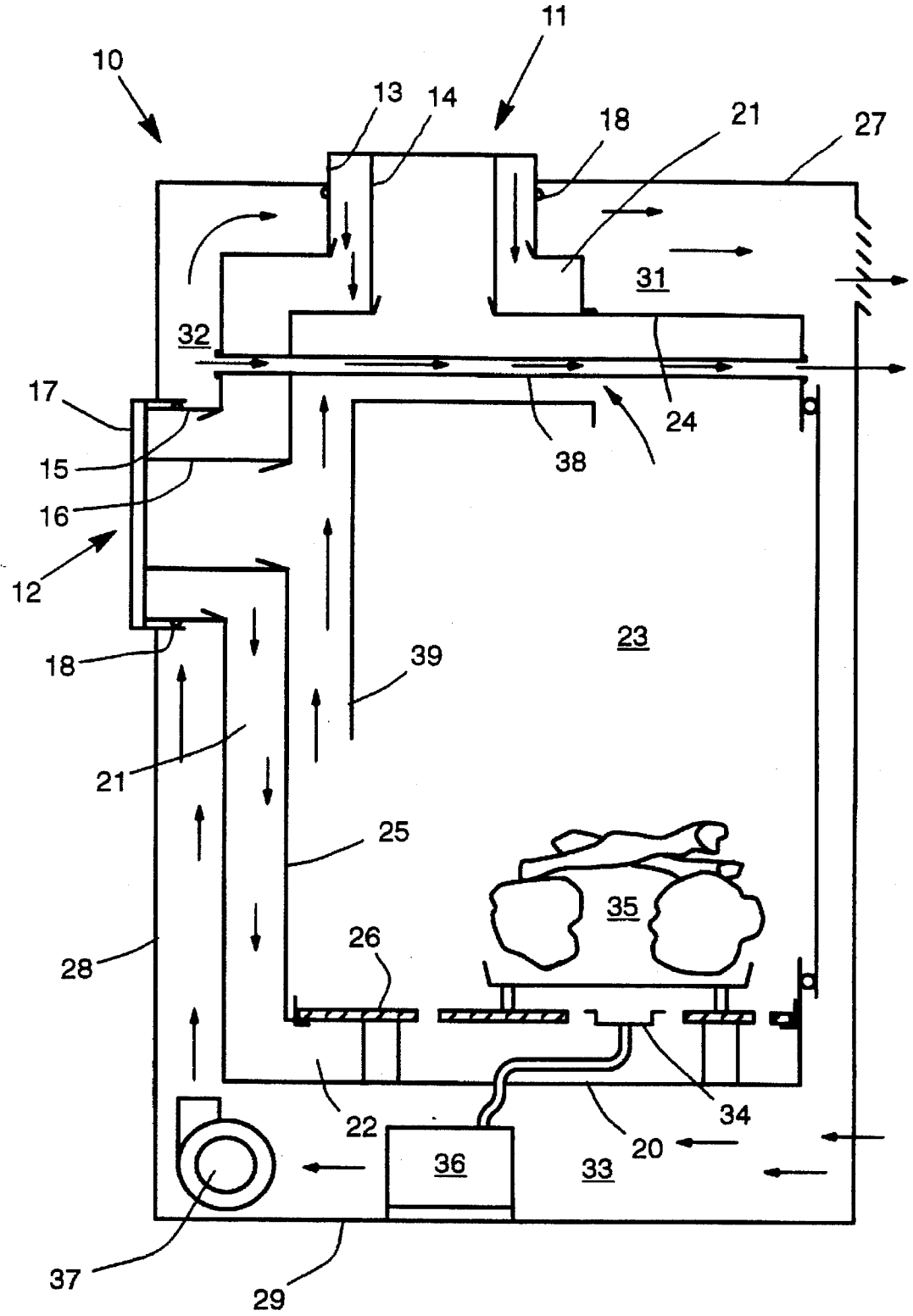
FIG. 1 is a side elevation in section taken through a preferred embodiment dual direct-vented fireplace showing the dual side vents capped and the dual top vents open.

Refer now to FIG. 1 showing a novel dual direct-vented fireplace 10 having a vertical venting means 11 and a horizontal venting means 12. For purposes of the descriptive terminology herein, the term venting means 11 or 12 refers to the fresh air vent 13 and the exhaust stack 14 which form a vertical venting means 11 or the elements 15, 16 which form the horizontal venting means 12. The preferred embodiment prefabricated fireplace 10 is further provided with means for sealing one of the two venting means 11 or 12. An economical seal is shown as a fabricated cap 17 having a twist lock or interrupted female screw feature which engages over raised interrupted male screw features on the fresh air vents 13 and 15. Conventional coupling means or the twist lock interrupted screw coupling means 18 may be used for sealing the stacks and vent pipes and is of the type disclosed in U.S. Pat. No. 5,165,732. Other well known means could be employed to fix a cap 17 or plate over the venting means 11 or 12. A mat of resilient insulating material 19 is precut to seal both the exhaust stack 14 and the vent pipe 13 which are preferably made as a coaxial pipe structure for reducing costs of manufacturing but could be made as separate exhausts and vent pipes for reasons other than cost and efficiency.

In the preferred embodiment of the present invention, a fresh combustion air plenum 21 is mounted on or connected onto the back wall of the combustion chamber and the top wall of the combustion chamber. Plenum 21 extends downward and connects to a fresh combustion air passageway 22 which preferably extends under panel 26 and/or connects directly into the combustion chamber 23.

The combustion chamber 23 is provided with an upper panel 24, rear panel 25 and a lower or bottom panel 26. The surround of the enclosure of the fireplace is provided with an upper panel 27, a rear panel 28 and a lower panel 29 which surrounds the combustion chamber. The space between the panels form upper wall 31, back wall 32 and bottom wall 33 which provides heat exchange passageways.

A flat pan gas burner 34 is shown positioned below a log system 35 which can be supported on the floor 20 or lower panel of the combustion chamber 26. The burner 34 is connected by a flexible pipe to the gas valve 36 which is located in the bottom wall 33. A blower system 37 is located in the bottom wall 33 which is part of a heat exchanger system formed by walls 31, 32 and 33. An optional second heat exchanger system is formed by a plurality of tubes 38 which increases the efficiency by heating the room air in the hottest part of the combustion chamber. There is further provided an adjustable baffle 39 of the type shown in U.S. Pat. No. 5,452,708 which directs the exhaust gas around the back of the combustion chamber 23 to enhance the heat exchanger effect.

Figure 2:
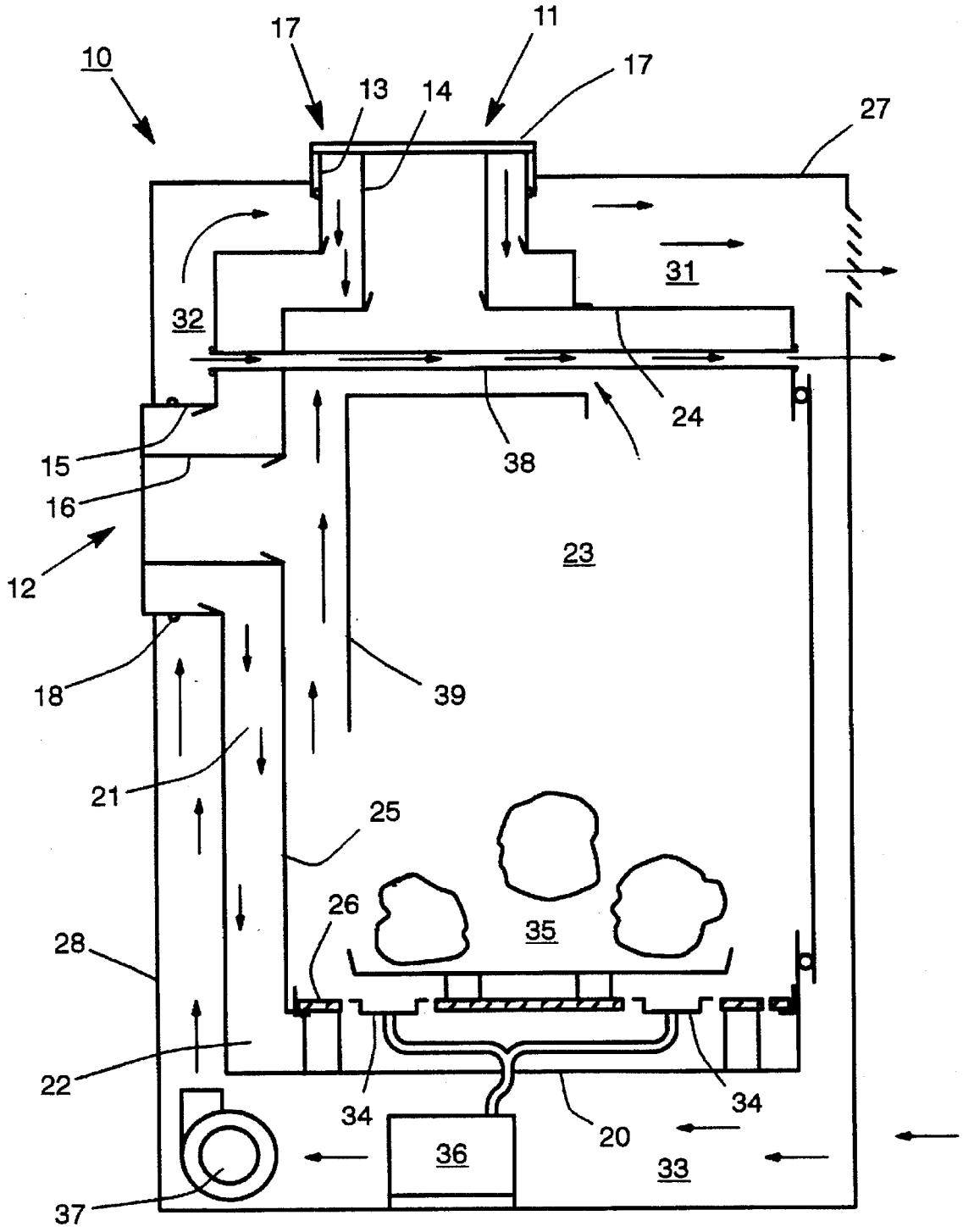
FIG. 2 is a side elevation in section through a fireplace showing open dual side vents and closed dual top vents in a fireplace having a pair of flat pan burners flush mounted in the floor panel of the combustion chamber.

Refer now to FIG. 2 showing a side elevation in section taken through a second preferred embodiment fireplace showing the top venting means 11 capped and the side venting means 12 open. The dual direct-vented fireplace shown in FIG. 2 is substantially the same as that shown in FIG. 1 and employs the same numerals where the elements are the same and these elements do not require additional explanation. It will be noted that two flat pan burners 34 are employed in a system which requires a slightly different log arrangement 35, otherwise the two fireplace systems are the same except for the fact that the vertical venting means 11 are capped or sealed which leaves the fireplace as a horizontal direct-vented system as distinguished from the vertical direct venting system shown in FIG. 1.

Figure 3:
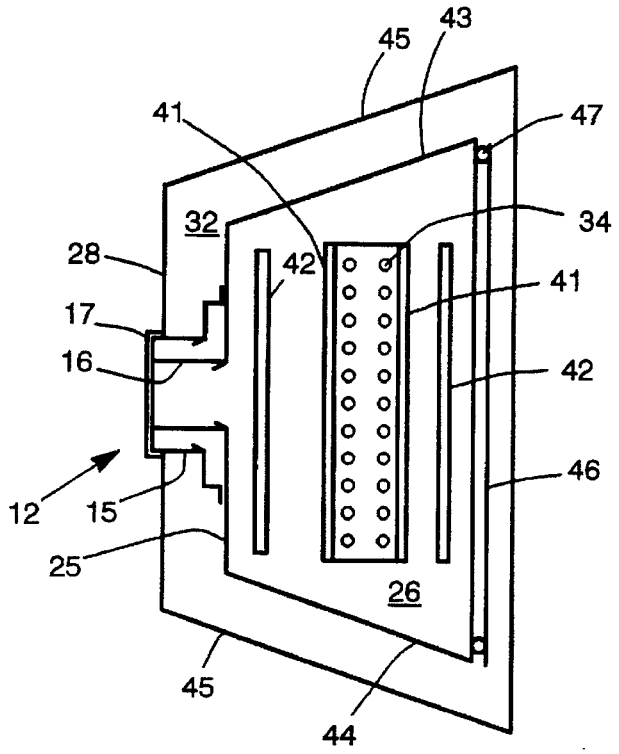
FIG. 3 is a top or plan view in section taken through the fireplace of FIG. 1 showing a single flat pan burner flush mounted in the floor panel of the combustion chamber.

Refer now to FIG. 3 showing a top or plan view in section of a preferred embodiment fireplace similar to that shown in FIG. 1 and showing a single flat pan burner 34 located in a slot of the bottom panel 26 of the combustion chamber 23. Adjacent to the burner 34 there are shown slots 41 which provide combustion air from the passageway 22 to the burner system 34. Additional slots 42 are shown for supplying additional combustion air into the combustion chamber 23. The combustion chamber 23 also includes side panels 43 and 44 as well as the aforementioned rear panel 25. The side panels 43 and 44 are spaced apart from the side panels 45 and 46 of the fireplace enclosure which is provided with a rear panel 28. The side and rear panels of the fireplace enclosure and combustion chamber are spaced apart from each other forming a plurality of walls which are connected to the aforementioned heat exchanger formed in the rear wall 32 as well as the top and bottom walls 31 and 33 described hereinbefore. The horizontal venting means 12 is shown comprising a horizontal exhaust pipe 16 and a horizontal combustion air vent pipe 15. In the fireplace shown in FIG. 3, a single glass side 46 is mounted across the front of the combustion chamber. This side wall or glass panel may be sealed by high temperature ceramic fiber adhesive means 47.

Figure 4:
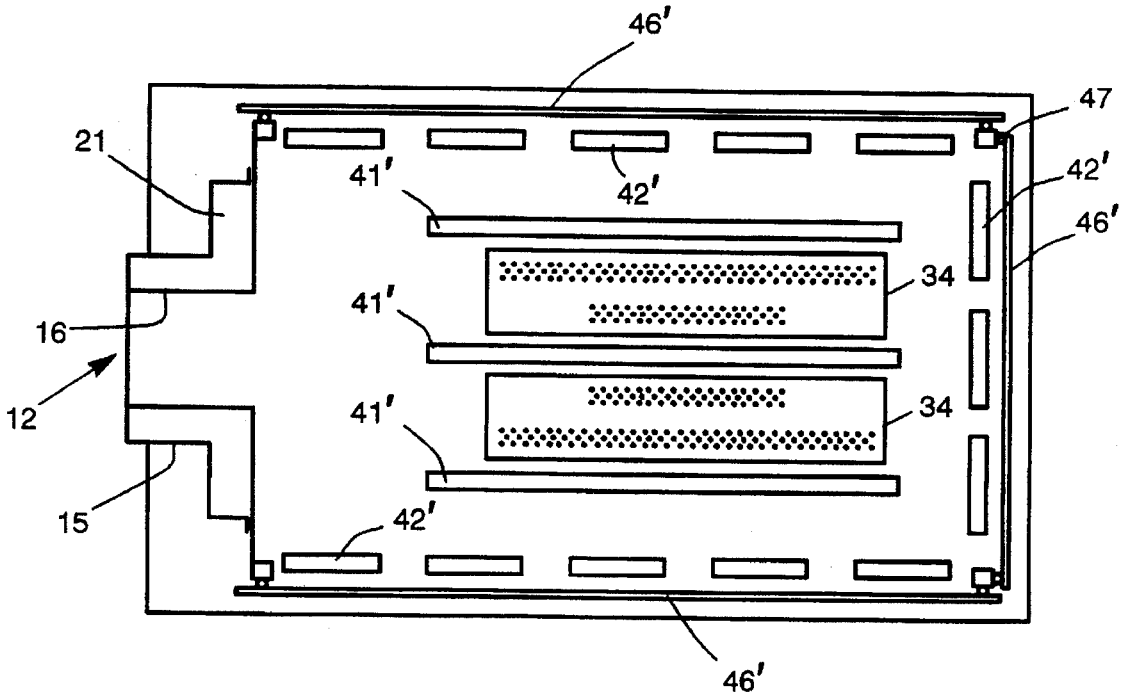
FIG. 4 is a top or plan view in section taken through a multi-glass side fireplace having a pair of flat pan burners flush mounted in the floor panel of the combustion chamber.

Refer now to FIG. 4 showing a top or plan view in section of a fireplace having an open side venting means 12 with preferred multi-glass side walls. The fireplace has a pair of flat pan burners 34. The pair of burners are located in the floor panel of the combustion chamber which is provided with slots 41' for supplying combustion air from the combustion air passageway 22 of the type shown in FIGS. 1 and 2. Further, additional air slots 42 are provided at the edges of the combustion chamber adjacent the glass panels 46' to provide additional combustion air as well as cooling air for the glass side wall which are mounted on vertical posts of the combustion chamber structure and sealed by the aforementioned ceramic fiber adhesive 47. The horizontal venting means 12 are substantially the same as that shown in FIGS. 1 and 2 and the venting means 12 shown comprises a horizontal exhaust stack 16 and a fresh air vent pipe 15 which connects into a plenum 21 which is shown directed downward and connects to the passageway 22 (not shown).

Figure 5:
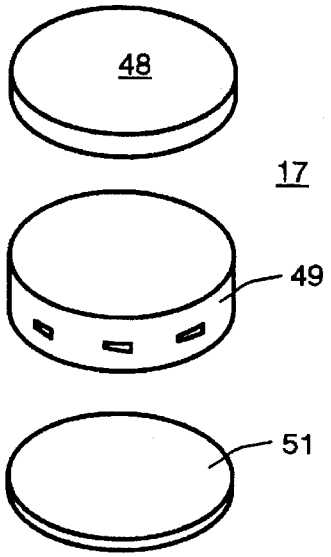
FIG. 5 is an exploded isometric view of a preferred embodiment sealing cap used to close one of the two exhaust vents.

Refer now FIG. 5 showing an exploded isometric view of a preferred embodiment sealing cap 17 used to close one of the two venting means 11 or 12. The preferred embodiment cap 17 comprises a cap top 48, an annular ring 49 which is connected thereto preferably by spot welding. Also shown is a insulating mat 51 which fits into the cap 17 and forms a seal when connected over the venting means 11 or 12.

Figure 6:
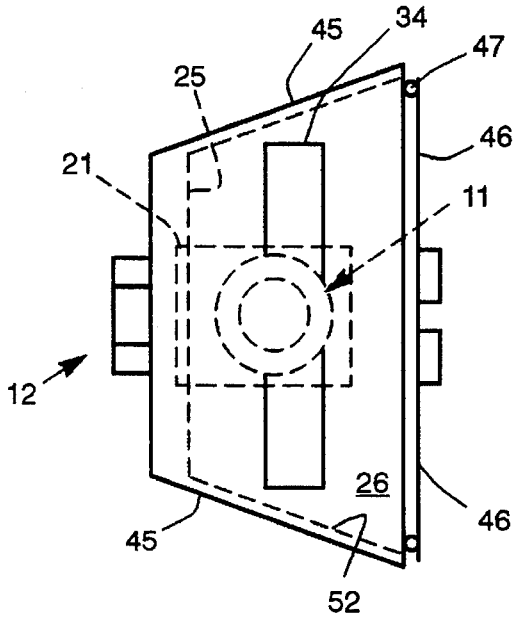
FIGS. 6 to 9 are plan view line drawings of the outline of different fireplace configurations showing the preferred location of dual vents, the location of the burner or burners and the location of glass sides of the fireplace.

Refer now FIGS. 6 to 9 showing schematic line drawings of the outlines of different fireplace configurations in plan view. FIG. 6 is a top view of a fireplace of the type shown in FIGS. 1 and 2 having horizontal venting means 12 and vertical venting means 11 shown in phantom lines. The aforementioned burner 34 is located in the floor panel 26 of the combustion chamber 23. Both the vertical venting means 11 and horizontal venting means 12 have their fresh air pipes connected to the plenum 21 described hereinbefore and shown now in phantom lines. The rear panel 25 of the combustion chamber 23 is the same as that shown in FIGS. 1 and 2, however, the side walls of the combustion chamber are now formed by cast ceramic panels made from vitreous alumina silicate fibers which are held together by a binder of amorphous silica and provide an insulating panel which is exposed to the heat in combustion chamber 23 yet maintains the outer panels of the fireplace enclosure 45 at a temperature less than 160 degrees Fahrenheit.

Figure 7:
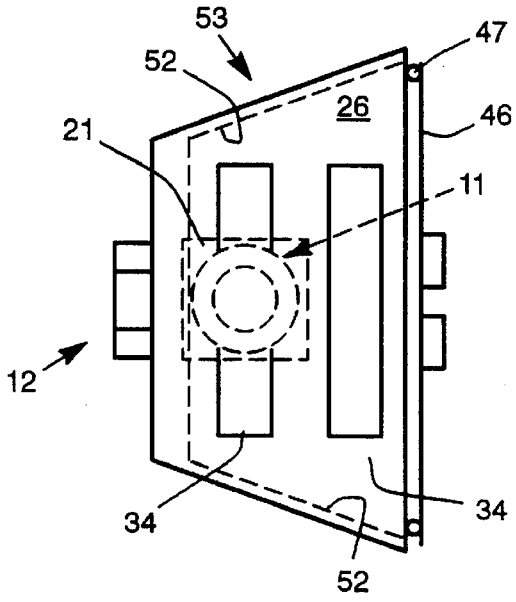

Refer now to FIG. 7 showing a fireplace enclosure 53 which is larger than the enclosure of the fireplace shown in FIG. 6. The enlarged enclosure fireplace also has an enlarged combustion chamber which has an enlarged floor panel 26' which has apertures to receive a pair of flat pan burners 34. The other numerals shown in FIG. 7 which are the same in those described hereinbefore with reference to FIGS. 1, 2 and 6 are numbered the same and do not require additional explanation.

Figure 8:
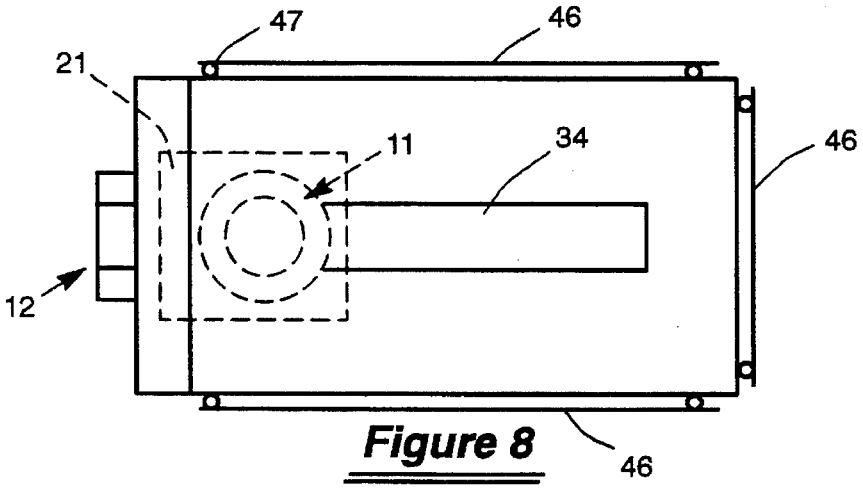
Figure 9:
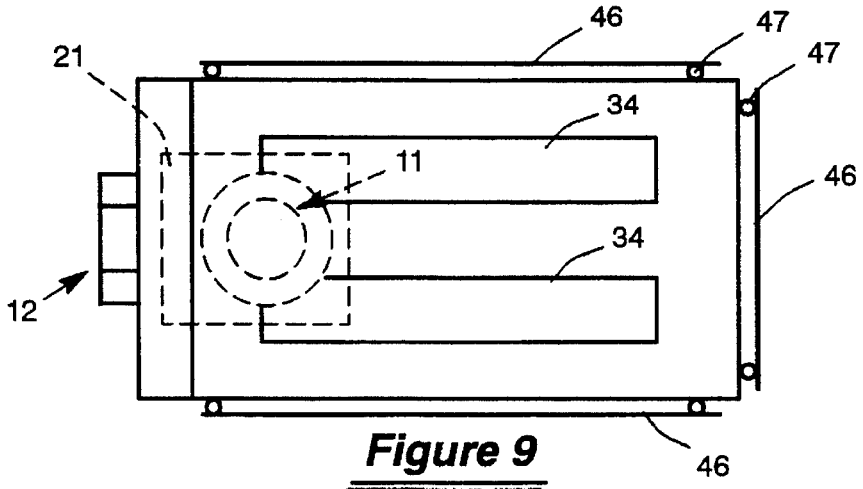

Refer now to FIGS. 8 and 9 showing a top or plan view multi-glass side wall fireplaces having either a single burner system 34 as shown in FIG. 8 or a pair of flat pan burners 34 as shown in FIG. 9. The venting means and the plenums described hereinbefore with reference FIGS. 4, 6 and 7 which are the same as those shown in FIGS. 8 and 9 are numbered the same and do not require additional explanation.

Having explained a preferred embodiment of the present invention and modifications thereof, it will be understood that the novel dual direct-vented fireplace is provided with both a horizontal venting means and a vertical venting means and that one of the venting means is disabled by providing a sealing means over the venting means. In this way, it is possible to manufacture a single universal fireplace of different types of configurations to meet two separate and distinct applications in the field. A feature of the present invention is that the sealing means is shipped with the fireplace system and may be changed from vertical to horizontal or horizontal to vertical as the case may be without the requirement of any tooling or additional parts. In the preferred embodiment, the cap twist locks or screw locks onto the outer vent pipe and the sealing insulating structure inside of the cap forms a seal. It may be desirable to close the exhaust stack of the unused venting means with high temperature insulation so that the unused cap never becomes hotter than the rear panel or the top panel of the fireplace enclosure.

What is claimed is:

1. A dual direct-vented fireplace, comprising:

a fireplace outer enclosure comprising two side panels, a top, a back and a bottom panel, a combustion chamber mounted inside of said outer enclosure having at least five wall panels comprising a top, a back and a bottom panel juxtaposed and spaced apart from the outer enclosure panels and forming three interconnected passageway walls of a heat exchange therebetween, means forming a fresh air plenum between the back walls of said outer enclosure and said combustion chamber and between the top walls of said outer enclosure and said combustion chamber, a means forming fresh air passageway below the bottom panel of said combustion chamber and connected to said fresh air plenum for conducting fresh combustion air to said combustion chamber, horizontal venting means and vertical venting means connected to said combustion chamber and having an exhaust stack extending through said top and said back walls of said outer enclosure and combustion chamber and also through said means forming a fresh air plenum, each said venting means comprising a fresh combustion air vent connected to said fresh air plenum and extending through the top and back panels of said fireplace outer enclosure, and sealing cap means for attaching over a predetermined one of said venting means for converting a dual direct-vented fireplace into a single direct-vented fireplace.

2. A dual direct-vented fireplace as set forth in claim 1 wherein said sealing cap means comprises a mat of resilient insulating material for forming a seal over an exhaust stack and a fresh combustion air vent.

3. A dual direct-vented fireplace as set forth in claim 2 wherein said sealing cap means comprises a formed cup shaped cap portion.

4. A dual direct-vented fireplace as set forth in claim 2 wherein said exhaust stack and said fresh combustion air vent form a coaxial pipe, and twist lock means formed on said venting means and said sealing cap means for attaching said sealing cap means on one said venting means.

5. A dual direct-vented fireplace as set forth in claim 4 wherein said twist lock means comprises a twist lock screw for attaching said sealing means cap on said venting means.

6. A dual direct-vented fireplace as set forth in claim 1 wherein said combustion chamber comprises a removable floor panel having a pattern of apertures comprising an aperture for at least one flat pan burner and slots for passageway of combustion air into said combustion chamber for adapting different burner systems to said dual direct-vented fireplace.

7. A dual direct-vented fireplace as set forth in claim 6 wherein said removable floor panel comprises a rigid panel of high temperature ceramic fiber material.

8. A dual direct-vented fireplace as set forth in claim 7 wherein said high temperature ceramic material comprises a non-porous cast ceramic vitreous alumina silicate fiber and amorphous silicate binder.

9. A dual direct-vented fireplace as set forth in claim 7 wherein said removable floor panel is provided with an embossed shaped pattern.

10. A dual direct-vented fireplace as set forth in claim 7 wherein the side panels of said combustion chamber are formed from a single rigid panel of high temperature ceramic fiber material.

11. A dual direct-vented fireplace as set forth in claim 1 which further includes baffle means mounted in said combustion chamber juxtaposed the exhaust stacks of said horizontal and said vertical venting means.

12. A dual direct vented fireplace, comprising:

a central combustion chamber having a pair of alternative selectable exhaust outlets, a fireplace enclosure surrounding at least three sides of said central combustion chamber and forming a heat exchanger around the outside of said combustion chamber, means forming a fresh air plenum mounted on the top and back of said combustion chamber having a pair of alternative selectable air inlets located over said exhaust outlets, coaxial pipe means connected to each of said pair of alternative exhaust outlets and said air inlets, and closure means coupled to one of said pair of alternative exhaust outlets and said air inlets for converting a dual direct-vented fireplace into a single direct-vented fireplace.

13. A method of assembling dual direct vented fireplaces to provide either a horizontal or a vertical direct-vented fireplace comprising the steps of:

providing a combustion chamber for a fireplace having both a horizontal exhaust outlet and a vertical exhaust outlet, surrounding at least the top, back and bottom of said combustion chamber with a fireplace enclosure to form top, back and bottom heat exchanger walls around said combustion chamber, forming a fresh air duct between the top and back heat exchanger walls, providing a separate horizontal air inlet and a vertical air inlet to said fresh air duct, providing means for connecting coaxial pipes to the vertical or horizontal exhaust outlets and to the vertical or horizontal air inlets, and connecting a closure to one of the said fresh air inlets and the said exhaust outlets of said combustion chamber to form a single direct-vented fireplace.

* * * * *